US006430771B2

(12) United States Patent
Ahern

(10) Patent No.: US 6,430,771 B2
(45) **Date of Patent: *Aug. 13, 2002**

(54) SCRUBBING MOPPING DEVICE FOR USE ON FOOT

(76) Inventor: Cathleen Ruth Ahern, 621 Riverside Ave., Haverhill, MA (US) 01830

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/225,225

(22) Filed: Jan. 4, 1999

(51) Int. Cl.[7] ..... A47L 13/12

(52) U.S. Cl. ..... 15/118; 15/227; 36/7.1 R; 36/7.3

(58) Field of Search ..... 15/227, 118; 36/7.1 R, 36/7.3, 8.1

(56) References Cited

U.S. PATENT DOCUMENTS

| | | | | | |
|---|---|---|---|---|---|
| 1,136,150 | A | | 4/1915 | McGrath | |
| 2,571,606 | A | | 10/1951 | Peterson | |
| 2,784,436 | A | | 3/1957 | Peterson | |
| 3,050,761 | A | * | 8/1962 | Morgan | 15/118 |
| 3,226,751 | A | * | 1/1966 | Lemelson | 15/118 |
| 5,144,759 | A | * | 1/1966 | Mascotte | 36/7.1 R |
| 3,362,775 | A | | 6/1968 | Muecke | |
| 3,526,014 | A | | 9/1970 | Edwards | |
| 3,699,672 | A | | 10/1972 | Sims | |
| 2,738,533 | A | | 3/1986 | Peterson | |
| 4,697,295 | A | | 10/1987 | Garrison | |
| 5,173,985 | A | | 12/1992 | Palmer | |
| 5,331,705 | A | * | 7/1994 | Melov | 15/118 |
| 5,408,718 | A | * | 4/1995 | Sadovsky | 15/118 |
| 5,613,897 | A | | 3/1997 | Thompson, Jr. | |
| 5,644,813 | A | | 7/1997 | Puskas | 15/227 |
| 5,881,423 | A | * | 3/1999 | Shumway et al. | 15/118 |
| 5,974,698 | A | * | 11/1999 | Nash et al. | 36/87 |
| 6,038,726 | A | * | 3/2000 | Kelly et al. | 15/227 |
| 6,047,434 | A | * | 4/2000 | Falwell | 15/227 |
| 6,052,856 | A | * | 4/2000 | DeMoya et al. | 15/227 |

* cited by examiner

*Primary Examiner*—Robert J. Warden, Sr.
*Assistant Examiner*—Kaj K. Olsen
(74) *Attorney, Agent, or Firm*—Pearson & Pearson, LLP

(57) ABSTRACT

A foot floor cleaning device with a scrubbing portion thereof is disclosed. The system is comprised of a slipper that the user wears on the feet while cleaning the floor. The bottom of the slipper device has a section at the heel and/or toe that is of an abrasive, scrubbing material which is attached to or attached over a section of absorbent material. This invention allows the user to scrub scuff marks and particles off the floor and dry the floor without bending to use the hands.

17 Claims, 2 Drawing Sheets

SCRUBBING MOPPING DEVICE FOR USE ON FOOT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

This invention directed to a foot floor cleaning device and more specifically to a feature thereof for scrubbing with the foot.

A variety of floor cleaning devices have been developed to be attached to or to go over the shoe. For example, U.S. Pat. No. 5,644,813 to Puskas, U.S. Pat. No. 2,571,606 to Peterson; U.S. Pat. No. 2,784,436 to Peterson; U.S. Pat. No. 2,784,533 to Peterson; U.S. Pat. No. 6,699,672 to Sims; U.S. Pat. No. 3,526,014 to Edwards, U.S. Pat. No. 3,362,775 to Muccke; U.S. Pat. No. 1,136,150 to McGrath; U.S. Pat. No. 4,697,295 to Garrison; U.S. Pat. No. 5,173,985 to Palmer are illustrative of prior art. While these devices are generally suitable for their particular purpose as they describe, they are not suitable for the purposes of this invention as described.

U.S. Pat. No. 5,644,813
Disposable Overshoe Mop
Paula Puskas

A disposable overshoe mop for mopping and/or absorbing water from a freshly mopped floor. It is comprised of two layers, the inside layer being waterproof, with the outside layer for mopping/absorbing.

U.S. Pat. No. 2,571,606
Foot Mop
Esther Peterson

A device for the foot in which one attaches a variety of mopping instruments to the bottom of such device. The user inserts the fore part of the foot into a stall on the device.

U.S. Pat. No. 2,784,436
Foot Mop with Detachable Foot Engaging Portion
Esther Peterson A device for the foot in which one attaches a variety of mopping instruments by laces to the bottom of such device. The user inserts the fore part of the foot into the device which is secured with a strap around the ankle.

U.S. Pat. No. 2,738,533
Floor Polishing Mop Means
Esther Peterson

A polishing device comprising of a bottom wall with an upper wall with an aperture designed to receive the foot of a person. A second waterproof wall under lies the bottom wall and has banks of cloth strands secured to clean the floor. Tape stitched around the outer peripheries of the bottom and second walls along with cooperating fasteners secure the second and bottom wall together.

U.S. Pat. No. 6,699,672
Floor Cleaning Device
Clarence R. Sims

A floor cleaning device adapted for securement to a shoe which is an elongated flexible pad of abrasive material positioned across the sole of a shoe and attached with a strap that extends up and over the top of the shoe.

U.S. Pat. No. 3,526,014
Foot Floor Scouring Attachment
Lester Edwards

A floor scouring sole pad attachment that is a stall into which the use inserts the fore part of the foot and is secured to the user's foot with a elastic heel band that extends rearwardly to encircle the heal of the user.

U.S. Pat. No. 3,362,775
Ann Muccke
Tootsie Mops

A device comprising of a foot operated mop having a shoe like member for the user to insert foot, having a sole with a chamber containing soap water which can be squeezed outwardly through openings on the underside of the sole for washing a floor.

U.S. Pat. No. 1,136,150
Floor Polisher
Lili Aline McGrath

Foot coverings for each foot designed for polishing by foot with a cord connecting the two.

U.S. Pat. No. 4,697,295
Floor cleaning device
Garrison

A towel like device with a pairs of pockets on the towel device that the user inserts ones feet into the pockets and drags ones feet across the floor. User changes pockets as the cleaning capacity is exhausted in that pocket area.

U.S. Pat. No. 5,173,985
Foot mounted scrubber device
Nancy K. Palmer

A foot mounted scrubber device which the user insert the foot the device. The device's sole plate is secured to the foot with an elastic heel strap.

BRIEF SUMMARY OF THE INVENTION

It is the object of this invention to provide a simple and convenient way to scrub scuff marks and particles stuck to the floor, off the floor without having to bend over, by using the foot, not the hand.

This invention overcomes the shortcoming of prior art devices in that there is a bottom layer with a portion of scrubbing material, which is permanently attached to or over another portion of the bottom layer comprised of a different material with absorption qualities, with the object to dry and polish a wet floor.

The scrubbing material for this purpose is a durable, woven abrasive nylon material with a rough texture so as to scrub floor surfaces but not so abrasive as to scratch the surface. It should be noted that any variety scrubbing materials with differing grades of abrasiveness may be substituted to suit the purpose of the surface to be cleaned.

It is also an object that there be an inner layer, to be waterproof, as to keep the foot dry. The inner waterproof layer can functionally stand alone, with the optional outer layer added for cosmetic purposes.

Another object is to provide a device that is economical in cost to manufacture. It can be made of inexpensive disposable materials or quality materials to last for many uses.

BRIEF DESCRIPTION OF THE DRAWINGS

List of Reference Numbers:

1. Scrubby material, toe portion
2. Scrubby material, heel portion
3. Absorbing material portion.
4. Optional Outer layer.

5. Inner waterproof layer.

6. Optional loop for hanging.

7. Entrance area.

8. Elastic or hook loop fastener (such as the type known as VELCRO) enclosure of 7.

9. Scrubby Mopper.

10. Ankle.

11. Leg.

12. Bottom layer.

13. Outer perimeter.

14. Upper outer perimeter.

15. Floor surface

Figure 1:
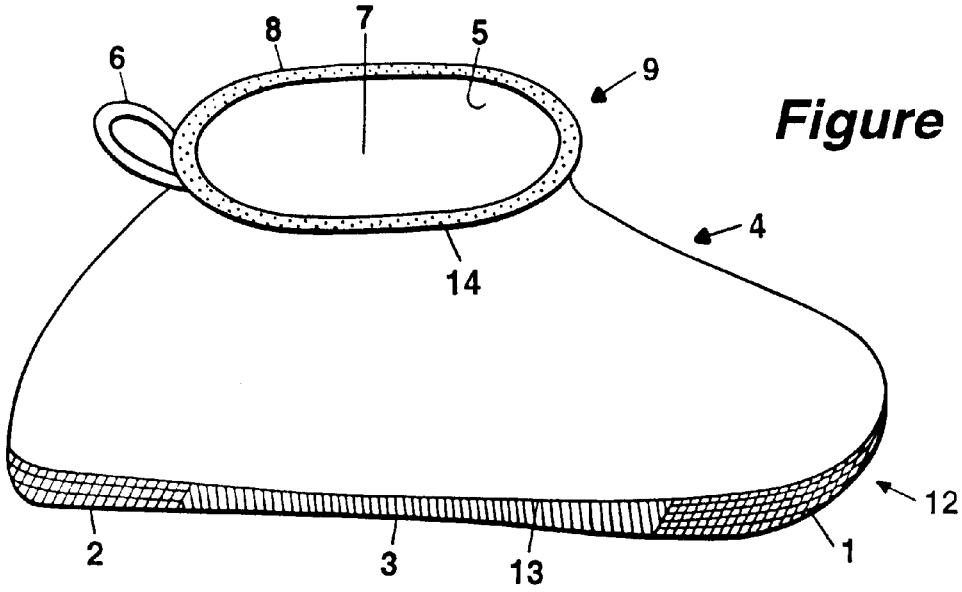

FIG. 1 is a side perspective view, showing the invention with the scrubbing material on both the heel and toe.

Figure 2:
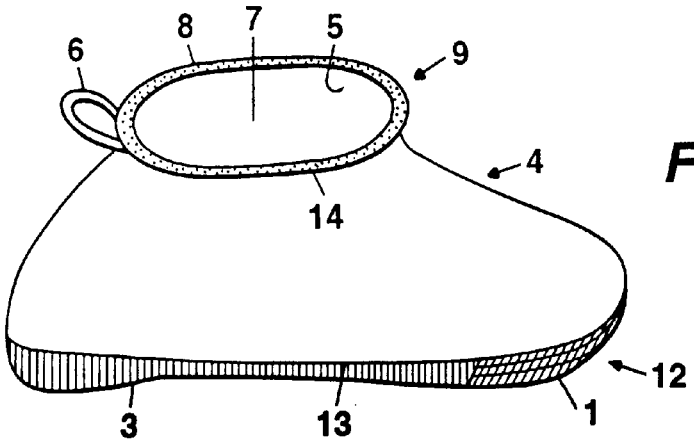

FIG. 2 is a side perspective, showing the scrubbing portion in the toe only.

Figure 3:
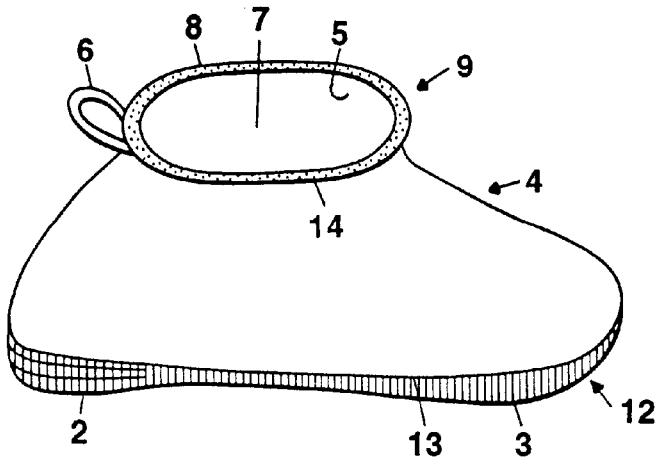

FIG. 3 is a side perspective, showing the scrubbing portion in the heel only.

Figure 4:
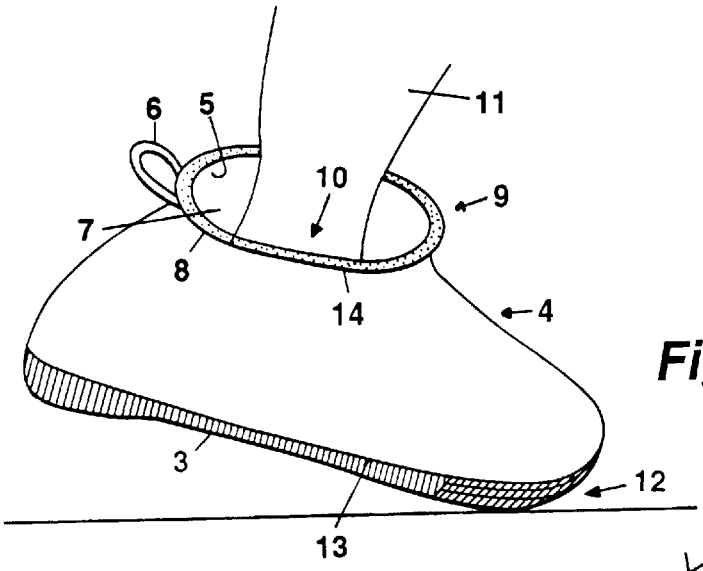

FIG. 4 is a side perspective showing the scrubbing portion in the toe in use by the tilting of the ankle, foot and toe forward and down, scrubbing the surface.

Figure 5:
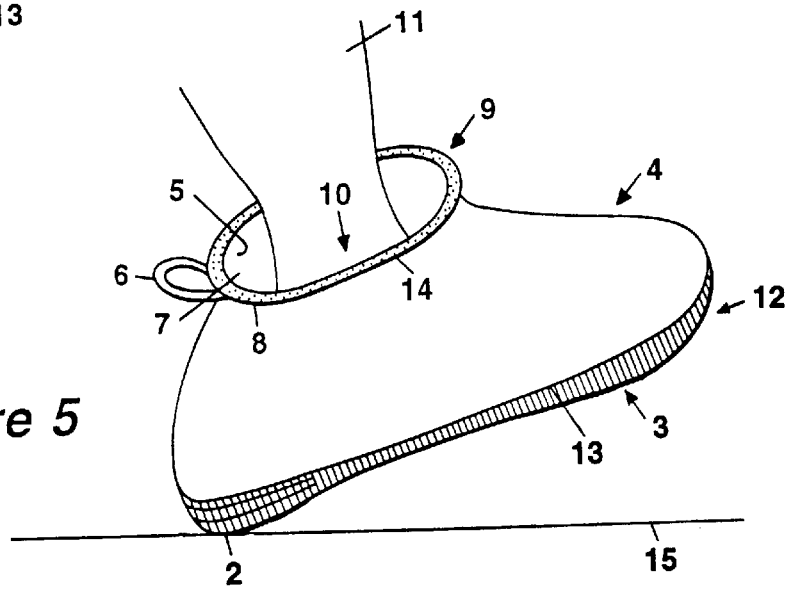

FIG. 5 is a side perspective showing the scrubbing portion in the heel in use by the tilting of the ankle, foot and heel backward and down, scrubbing the surface.

Figure 6:
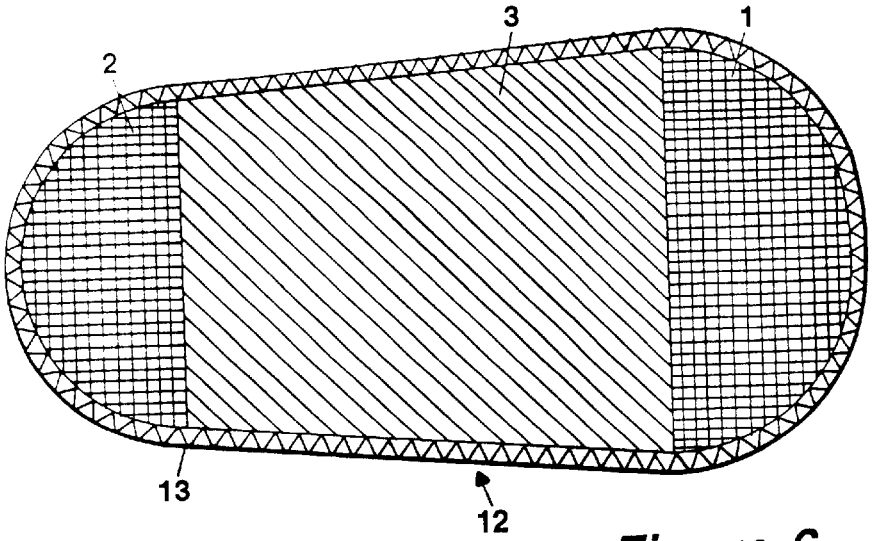

FIG. 6 is a bottom view of the different materials for different purposes attached to each other to form one unit.

DETAILED DESCRIPTION OF THE INVENTION

FIGS. 1–6 illustrate a scrubby mopper 9 comprised of an optional outer layer 4, attached to and covering the inner waterproof layer 5 with an opening 7, into which a person inserts foot or shoe.

The inner waterproof layer 5 and the optional outer layer 4 together cover the foot or shoe to the ankle area and is secured to the ankle area with elastic 8 or any other means such as hook loop fasteners (such as the type known as VELCRO), which may secure the scrubby mopper 9, around the ankle area. An optional loop 6 for convenient hanging is attached to elastic area 8 or optional outer layer 4. The optional outer layer 4 and the inner waterproof layer 5 are permanently attached to bottom layer 12 by means of sewing or adhesive.

The bottom layer 12 shaped to fit the shoe or foot, consists of a scrubbing material which is either or both, at the front toe portion 1 and/or at the back heel portion 2, which is permanently attached to or over a different material with absorption qualities with the additional area to be the absorbent material alone 3 to form the bottom layer 12. The bottom layer components are permanently bonded together by means of sewing or other adhesives.

The inner waterproof layer 5, the optional outer layer 4 and the bottom layer 12 are permanently attached at the outer perimeter 13. The optional outer layer 4 and the inner waterproof layer 5, attach additionally at the upper outer perimeter 14 and are attached in such a way so as not to compromise the waterproof qualities of the inner waterproof layer 5.

As shown in FIGS. 2, 2A and 2B, tilting the leg 11 and ankle 10 either forward or backward and applying pressure to the floor utilizes the scrubby feature of 1 and 2 of the scrubby mopper 9.

To use the scrubby mopper:

1. Insert the left foot or left shoe into the stretchable opening 7 of the enclosure 8.
2. Insert the right foot or right shoe into the stretchable opening 7 of the enclosure 8.
3. Wash the floor with any mop.
4. While mopping, to use the scrubby portion 1, tilt the leg 11 and ankle 10 forward, or to use the scrubby portion 2, tilt the leg 11 and ankle 10 backward and apply pressure to the floor to scrub the surface to remove stuck on particles and scuff marks.
5. While mopping and/or after mopping, walk over wet areas to allow absorbent material 3, to absorb water and dry the floor.

Although a detailed description of scrubby moppers according to one embodiment of the present invention has been provided, it should be understood that the scope of the invention is not to be limited thereby. The scope of the invention is to be determined by the claims which follows and any modifications or alternatives apparent to one of ordinary skill in the art.

What I claim is:

1. A foot scrubbing mopping device to be worn on at least one foot of a user, said foot scrubbing mopping device comprising:

an inner layer having a bottom region and an upper region defining an opening, for receiving the foot such that said upper region is adjacent a top of the foot and said bottom region is adjacent a bottom of the foot;

an absorbent material covering at least a central portion of said bottom region of said inner layer, for mopping; and a scrubbing material covering a toe region of said bottom region of said inner layer, wherein said scrubbing material extends directly beneath toes of said user and wherein an outer bottom surface of said scrubbing material forms a continuous plane or unbroken surface with an outer bottom surface of said absorbent material such that downward pressure applied by said toes causes said scrubbing material to scrub a surface directly beneath said toes.

2. The foot scrubbing mopping device of claim 1 further comprising:

a second scrubbing material covering a heel region of said bottom region of said inner layer, wherein said second scrubbing material extends beneath the heel of said user and wherein an outer bottom surface of said scrubbing material forms a continuous plane or unbroken surface with an outer bottom surface of said absorbent material such that downward pressure applied by said heel causes said scrubbing material to scrub a surface beneath said heel.

3. The foot scrubbing mopping device of claim 1 further including a fastening device located proximate said opening, for fastening to the user.

4. The foot scrubbing mopping device of claim 3 wherein said fastening device includes an elastic.

5. The foot scrubbing mopping device of claim 3 wherein said fastening device includes a hook and loop strap.

6. The foot scrubbing mopping device of claim 1 wherein said scrubbing material covers a region proximate a heel of the user.

7. The foot scrubbing mopping device of claim 1 wherein said inner layer is a waterproofing layer.

8. The foot scrubbing mopping device of claim 7 further including an outer layer covering said upper region of said waterproofing layer.

9. The foot scrubbing mopping device of claim 1 further including a loop attached to said scrubbing mopping device for hanging.

10. The foot scrubbing mopping device of claim 1 wherein said scrubbing material includes woven abrasive nylon material.

11. The foot scrubbing mopping device of claim 10 wherein said bottom region and said upper region of said inner layer are attached together at a perimeter.

12. A foot scrubbing mopping device to be worn on at least one foot of a user, said foot scrubbing mopping device comprising:

an inner layer having a bottom region and an upper region defining an opening, for receiving the foot such that said upper region is adjacent a top of the foot and said bottom region is adjacent a bottom of the foot;

an absorbent material covering at least a central portion of said bottom region of said inner layer, for mopping;

a scrubbing material covering a toe region of said bottom region of said inner layer, wherein said scrubbing material extends directly beneath toes of said user and wherein an outer bottom surface of said scrubbing material forms a continuous plane or unbroken surface with an outer bottom surface of said absorbent material such that downward pressure applied by said toes causes said scrubbing material to scrub a surface directly beneath said toes;

a second scrubbing material covering a heel region of said bottom region of said inner layer, wherein said second scrubbing material extends beneath the heel of said user and wherein an outer bottom surface of said scrubbing material forms a continuous plane or unbroken surface with an outer bottom surface of said absorbent material such that downward pressure applied by said heel causes said scrubbing material to scrub a surface beneath said heel;

an outer layer covering said upper regions of said inner layer, said inner layer being a waterproof layer; and said inner waterproof layer, said outer layer and said bottom layer being attached at an outer perimeter around the bottom of said mopping device and said outer layer and said inner waterproof layer being additionally attached at an upper outer perimeter of said mopping device around said opening.

13. The foot scrubbing mopping device of claim 12 further including a fastening device located proximate said opening, for fastening to the user.

14. The foot scrubbing mopping device of claim 13 wherein said fastening device includes an elastic.

15. The foot scrubbing mopping device of claim 13 wherein said fastening device includes a hook and loop strap.

16. The foot scrubbing mopping device of claim 12 further including a loop attached to said scrubbing mopping device for hanging.

17. The foot scrubbing mopping device of claim 12 wherein said scrubbing material includes woven abrasive nylon material.

* * * * *